US010208566B2

(12) United States Patent
Trahan et al.

(10) Patent No.: US 10,208,566 B2
(45) Date of Patent: Feb. 19, 2019

(54) WELLBORE STIMULATION TOOL, ASSEMBLY AND METHOD

(71) Applicant: Packers Plus Energy Services, Inc., Calgary (CA)

(72) Inventors: Kevin O. Trahan, The Woodlands, TX (US); Justin B. Johnson, The Woodlands, TX (US); Jabian P. Trahan, Humble, TX (US)

( * ) Notice: Subject to any disclaimer, the term of this patent is extended or adjusted under 35 U.S.C. 154(b) by 126 days.

(21) Appl. No.: 15/109,069

(22) PCT Filed: Jan. 23, 2015

(86) PCT No.: PCT/US2015/012761

§ 371 (c)(1),
(2) Date: Jun. 29, 2016

(87) PCT Pub. No.: WO2015/112905

PCT Pub. Date: Jul. 30, 2015

(65) Prior Publication Data

US 2016/0326835 A1 Nov. 10, 2016

Related U.S. Application Data

(60) Provisional application No. 61/931,371, filed on Jan. 24, 2014.

(51) Int. Cl.

| | |
|---|---|
| ***E21B 34/10*** | (2006.01) |
| ***E21B 43/26*** | (2006.01) |
| ***E21B 43/14*** | (2006.01) |
| ***E21B 34/14*** | (2006.01) |
| ***E21B 34/00*** | (2006.01) |
| ***E21B 23/00*** | (2006.01) |
| ***E21B 23/02*** | (2006.01) |

(52) U.S. Cl.

CPC ..... *E21B 34/10* (2013.01); *E21B 23/006* (2013.01); *E21B 23/02* (2013.01); *E21B 34/102* (2013.01); *E21B 34/103* (2013.01); *E21B 34/14* (2013.01); *E21B 43/14* (2013.01); *E21B 43/26* (2013.01); *E21B 2034/007* (2013.01)

(58) Field of Classification Search

CPC ..... E21B 34/10; E21B 43/26; E21B 43/14; E21B 34/14; E21B 33/12; E21B 23/006; E21B 34/103; E21B 34/102; E21B 23/02; E21B 2034/007

See application file for complete search history.

(56) References Cited

U.S. PATENT DOCUMENTS

| | | | | |
|---|---|---|---|---|
| 2,935,751 | A | 5/1960 | Emmick et al. | |
| 4,151,880 | A | 5/1979 | Vann | |
| 4,241,796 | A | 12/1980 | Green | |
| 4,330,039 | A * | 5/1982 | Vann | E21B 33/12 166/297 |
| 4,429,747 | A * | 2/1984 | Williamson, Jr. | E21B 34/14 166/321 |
| 8,613,321 | B2 | 12/2013 | Ravensbergen et al. | |
| 8,794,331 | B2 | 8/2014 | Getzlaf et al. | |
| 2005/0126787 | A1 * | 6/2005 | Gomez | E21B 34/102 166/319 |

(Continued)

*Primary Examiner* — Michael R Wills, III

(57) ABSTRACT

A tubing string ported sub including a valve covering the port that can be opened by a pressure differential established across the valve. The valve includes an exposed portion that can be engaged to mechanically shift the valve.

17 Claims, 6 Drawing Sheets

(56) References Cited

U.S. PATENT DOCUMENTS

| | | | | |
|---|---|---|---|---|
| 2010/0089587 | A1* | 4/2010 | Stout | E21B 23/04 166/319 |
| 2010/0126725 | A1 | 5/2010 | Ravensbergen | |
| 2011/0168410 | A1 | 7/2011 | Deboer | |
| 2011/0174491 | A1 | 7/2011 | Ravensbergen et al. | |
| 2011/0308817 | A1 | 12/2011 | Ravensbergen | |
| 2012/0097398 | A1 | 4/2012 | Ravensbergen et al. | |

* cited by examiner

WELLBORE STIMULATION TOOL, ASSEMBLY AND METHOD

FIELD OF THE INVENTION

The invention disclosed herein relates generally to oil and gas well completion and stimulation. More particularly, the present invention relates to a tool for wellbore stimulation.

BACKGROUND OF THE INVENTION

Tools for use in the stimulation of oil and gas wells are generally well known. For example, perforating tools deployed down-hole on wireline, slickline, cable, or on a tubing string, and sealing devices such as bridge plugs and frac plugs are commonly used to isolate portions of the wellbore during fluid treatment of the wellbore. Alternatively, frac sleeves, frac ports, and/or frac shifting pistons are commonly used to provide stimulation passageways from inside the production tubing to isolate sections of a hydrocarbon laden formation exposed in a wellbore. One of the most common methods for opening frac sleeves, frac ports, and/or frac shifting pistons is the application of a ball seat within each tubing string ported sub, where the internal diameter of the ball seat of each tubing string ported sub is slightly smaller than the ball seat of the tubing string ported sub positioned directly up-hole. This allows multiple tubing string ported subs to be installed in a single well, while maintaining the ability to selectively open each tubing string ported sub at the desired moment. It is understood by those skilled in the art that graduating ball seat sizes have a limitation in terms of the number of tubing string ported subs which may be selectively opened in a wellbore, the limitation created by the number of differently sized balls which may be utilized within the limited internal diameter of the production tubing. Another method commonly used for shifting tubing string ported subs is the application of an anchoring and sealing device, deployed on a workstring. The anchoring and sealing device can be selectively set within a tubing string ported sub for opening a stimulation passageway in the tubing string ported sub. These types of tubing string ported subs, along with their associated anchoring and sealing devices, may be preferred in certain applications due to; a) more tubing string ported subs may be installed in a single well, and b) the production tubing is left in a fully open condition after stimulations are complete, therefore allowing unimpeded production without requiring drilling of bridge plugs or ball seats.

SUMMARY

In accordance with a broad aspect of the present invention, there is provided a tubing string sub comprising: a tubular wall defining an inner bore; at least one port through the wall to provide fluid communication between an outer surface of the tubular wall and the inner bore; a valve chamber within the tubular wall adjacent the port, the valve chamber having an open end; at least one vent passageway positioned to provide fluid communication between the valve chamber and the inner bore; and a valve positioned in the valve chamber with a portion protruding from the open end and the portion configured for opening and closing the port, the valve being configured to shift to open the port when a pressure differential is created between the open end and the vent passageway.

In accordance with another broad aspect of the present invention, there is provided a wellbore assembly comprising: a tubing string including a tubing string sub, the sub including: a tubular wall defining an inner bore; at least one port through the wall to provide fluid communication between an outer surface of the tubular wall and the inner bore; a valve chamber within the tubular wall adjacent the port, the valve chamber having an open end; a vent passageway positioned to provide fluid communication between the valve chamber and the inner bore; and a valve positioned in the valve chamber with a portion protruding from the open end and the portion configured for opening and closing the port, the valve being configured to shift to open the port when a pressure differential is created between the open end and the vent passageway In accordance with another broad aspect of the present invention, there is provided a method for stimulating a wellbore, the method comprising: moving a shifting tool within a tubing string in the wellbore to a position adjacent a tubing string sub, the sub including: a tubular wall defining an inner bore; at least one port through the wall to provide fluid communication between an outer surface of the tubular wall and the inner bore; a valve chamber within the tubular wall adjacent the port, the valve chamber having an open end; a vent passageway positioned to provide fluid communication between the valve chamber and the inner bore; and a valve positioned in the valve chamber with a portion protruding from the open end and the portion configured for opening and closing the port; setting a packing element of the shifting tool between the open end and the vent passageway; creating a pressure differential across the packing element to shift the valve to open the port; and introducing fluid through the port to stimulate the formation

BRIEF DESCRIPTION OF THE DRAWINGS

Embodiments of the present invention will now be described, by way of example only, with reference to the attached figures;

FIG. 1*b* provides a clear view of the locking profile which is engaged once the shifting piston moves to its final and open position.

DETAILED DESCRIPTION OF VARIOUS EMBODIMENTS

A tubing string ported sub, tubing assembly and method are described herein for stimulating a formation accessed through a wellbore.

The tubing string sub contains ports for flowing stimulation fluids into an adjacent formation at the desired time to stimulate the formation. The ported sub contains a shifting piston which maintains the ports in a closed condition until the desired time. When compared to prior tubing string ported subs, the shifting piston provides for increased pressure holding capability, which for example, is useful during other stimulations in the same wellbore. Also when compared to prior tubing string ported subs, the present sub may offer decreased loading when the shifting piston is moved to open the port.

The shifting piston is caused to move by generation of a pressure differential thereacross, which is affected by a shifting device. The shifting piston can open only when the associated shifting tool is placed within the sub and a seal of the shifting tool is set to permit the generation of a pressure differential between opposite sides of the seal. The shifting tool can be set to create the seal adjacent the shifting piston so that the pressure differential acts across the shifting piston. The shifting tool may be positioned by use of a locating assembly for example, in the form of a collet. The shifting tool is deployed and removed with a workstring.

The ported sub can have an inner bore similar, for example with a similar inner diameter, to the production tubing string. Therefore, the tubing string ported sub need not create a restriction in the tubing and no drilling of internal components is likely required for future access to the tubing below the tool assembly.

While the shifting piston of the tool assembly does not need to be engaged by the shifting tool, the shifting piston has an internal diameter accessible to tools which are deployed in the tubing string. Therefore, the shifting piston can be moved by mechanical engagement if need be. In addition, the shifting piston may be relatively thick at least at its portion overlying the ports, thereby providing the tool with a high pressure rating.

Figure 6:
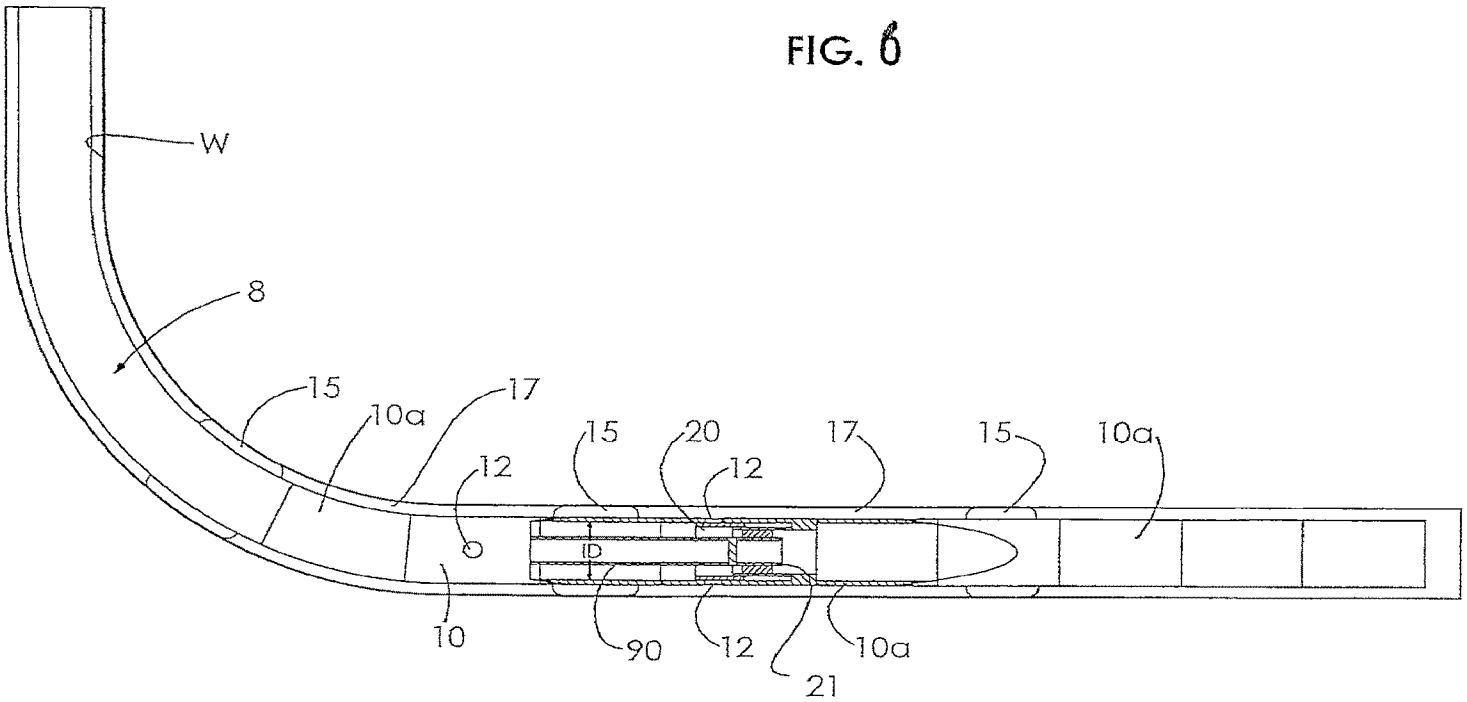
FIG. 6 is a schematic view through a wellbore with a ported sub installed therein.

With reference to FIG. 6, a formation may be stimulated by introducing fluids through a wellbore W to the formation. Fluids may stimulate the formation by mechanical or chemical processes. Fracturing, also called fracing, is a common form of wellbore stimulation wherein fluids are injected to the well at high pressures to cause a fracture in the formation. The term fracturing has become synonymous with the term stimulation, and those terms are used herein interchangeably.

A tubing string 8 is installed to provide a conduit through the wellbore to the formation. The tubing string is formed of a plurality of tubulars connected end to end. These tubulars are commonly called subs or joints 10, 10*a*. Some subs 10 include ports 12 through their tubular walls. When the ports are opened, fluids can pass through ports 12 between the inner diameter ID of the tubular and its outer surface. The ported sub may include a shifting piston 20 that allows configuration of the ports between a closed condition and an open condition, which is shown in FIG. 6. Depending on the form of the sub, the shifting piston may be a plug, a sleeve, etc.

While the ports may be normally closed, the shifting piston may be opened to permit fluid flows through the ports. To open the shifting piston, a shifting tool 21 is positioned in the inner diameter ID of the string to permit the formation of a pressure differential to move the shifting piston.

Tubing string 8 may be installed as an open hole installation or may be cemented in the well. The well may be horizontal, vertical or deviated.

Ported subs 10 can be positioned in the tubing string wherever it is desired to access the formation for stimulation thereof. In an embodiment, the ported subs 10 of the present disclosure can be positioned in each zone of a multi-zone well. For example, ported subs may be positioned in the isolated zones between external packers 15 that span the annulus 17 between tubing string 8 and the wall of wellbore W.

Figure 1:
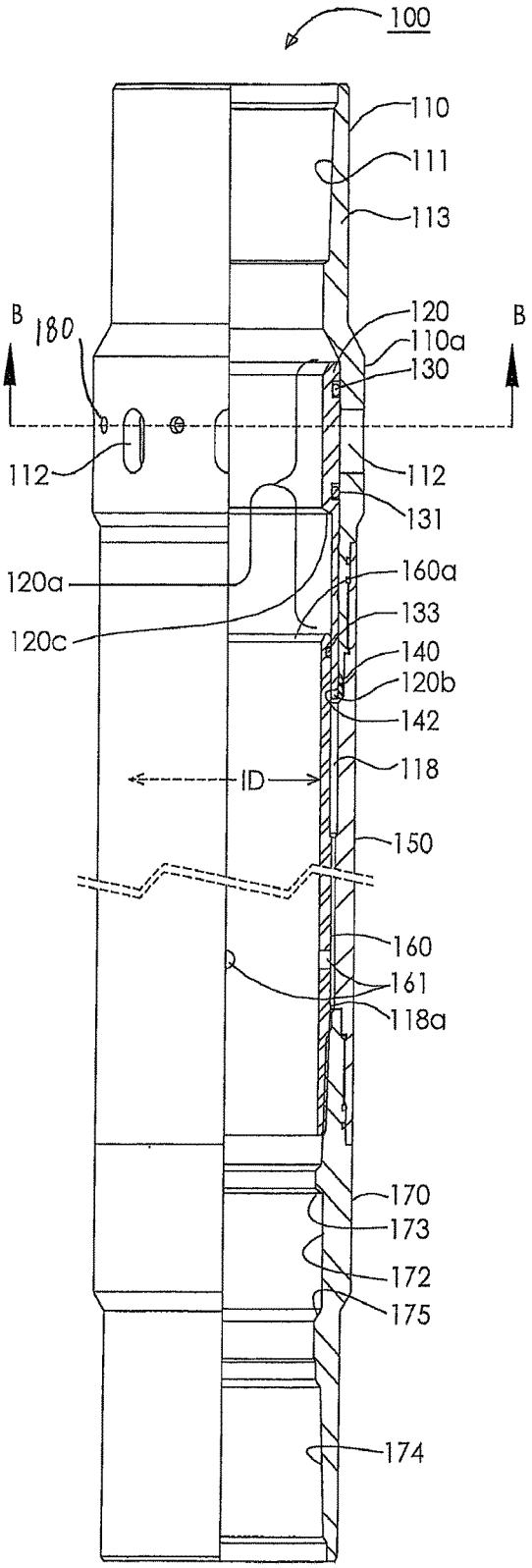
FIG. 1 is a quarter-sectioned view of the tubing string ported sub tool assembly depicting the tool in the pressure holding, or run-in, configuration wherein the shifting piston prevents flow through the wall of the tool from the inside to the outside of the tool.
Figure 1A:
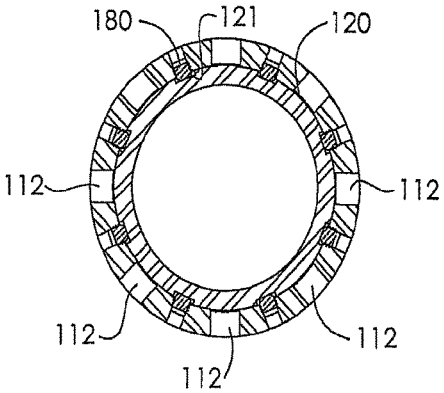
FIG. 1*a* shows a section view along B-B of FIG. 1. This section shows a possible shear feature. The section is at a plane located at the shear screws which hold the shifting piston in its original position until desired shifting. The shear screws are offset from the frac ports.
Figure 1B:
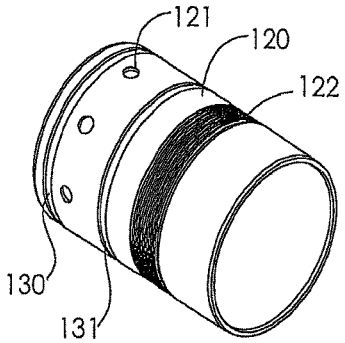
FIG. 1*b* is a perspective view of the outside of the shifting piston from the tool embodiment of FIG. 1.
Figure 1C:
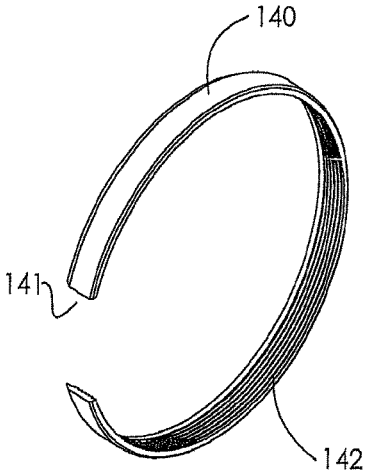
FIG. 1*c* is a perspective view of a locking component which engages the shifting piston upon its movement to the final and open position. The view provides further clarity to the functionality of the locking component.

With reference to FIGS. 1 to 1*c*, one embodiment of a ported sub 100 is illustrated. The illustrated ported sub 100 comprises a tubular wall 110. While the tubular wall may be formed in various ways, it will be appreciated that in wellbore tools, such tubular structures are often formed of interconnected parts. For example, here the tubular wall includes an upper end 113, a lower end 170 and an intermediate body including an outer wall 150 and an inner wall 160.

Ported sub 100 can attach to other subs to form a tubing string by any suitable mechanism. In an embodiment, ported sub 100 can include threaded ends 111, 174 such as threaded boxes or pins.

Ports 112 extend through tubular wall 110 and, when open, provide for fluid communication between the inner bore, defined by the dimension inner diameter ID, and the outer surface 110*a*. In this illustrated embodiment, ports 112 extend through a single wall thickness and here extend through a portion of upper end 113.

Figure 4:
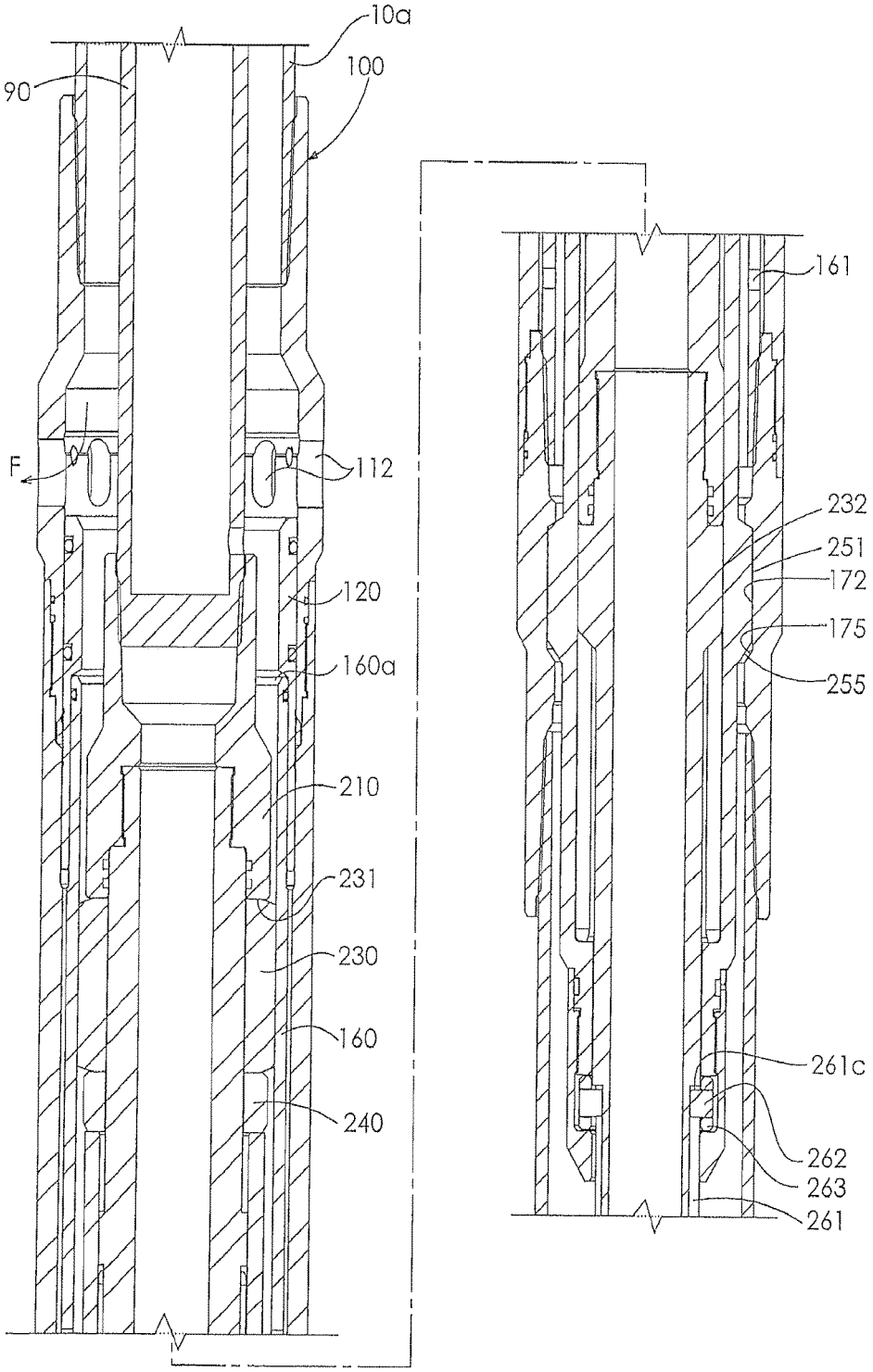
FIG. 4 is a section view of the tool assembly in the open, or stimulating, position with the associated shifting tool shown positioned in the anchoring and sealing, or downwardly stroked position.

A shifting piston, shown here as a sleeve 120, acts as a valve to open and close the ports. The sleeve 120 is movable between a closed position, as shown in FIGS. 1 and 1*a*, overlying ports 112 and an open position, as shown in FIG. 4, wherein the sleeve is retracted at least to some degree from over ports 112 and permits communication between the inner diameter of the tubular wall 110 and outer surface 110*a*. When the sleeve is in the closed position, seals 130, 131 seal against leakage between sleeve 120 and wall 110 through ports 112.

Sleeve 120 is mounted in the sub with a mounting portion 120*b* secured in a valve chamber and an exposed portion 120*a* protruding out of the valve chamber.

Exposed portion 120*a* is exposed in inner diameter ID. In this illustrated embodiment, exposed portion 120*a* is the full annular, upper end portion of the sleeve. In particular, exposed portion 120*a* may be exposed in the tubular inner bore about its full circumference. Exposed portion 120*a* is positioned to overlie ports 112 in the closed position. Sleeve 120 may have a thickness at least along a portion of this exposed portion 120*a* to give the sub a high pressure rating. In particular, the thicker the sleeve portion that overlies the ports 112, the greater the possible pressure rating of the sub.

Mounting portion 120*b* is installed in the valve chamber, which in this embodiment is an annulus 118 between the outer wall 150 and inner wall 160. The annulus 118 extends around the circumference of the tubular wall and has an open end into which sleeve 120 extends and an end wall 118*a* opposite the open end. Outer wall 150 and inner wall 160 form the annulus between them. In particular, while outer wall 150 connects the upper end 113 and the lower end 170 of the tubular wall, inner wall 160 is a thin walled tubular connected at one end to the remainder of the tubular wall and extending substantially concentrically relative to outer wall 150 to a free end 160*a*. The open end of the annulus is effectively formed where inner wall 160 ends at its free end 160*a*.

Mounting portion 120*b* of the sleeve may be thinner than exposed portion 120*a*. In particular, the wall thickness of any wellbore tubular is limited, and in this tubular, the wall thickness where the sleeve is secured accommodates mounting portion 120*b* of sleeve, as well as the inner wall 160 and the outer wall 150, the thickness of mounting portion 120*b* alone may be limited. Thus, the thickness of the sleeve at mounting portion 120*b* may be restricted relative to the possible thickness of the sleeve at exposed portion 120*a*, wherein there need be only two structures positioned forming the maximum wall thickness. Thus sleeve 120 may have the benefits of an annularly mounted sleeve, but a thickness offering a high pressure rating at that exposed portion 120*a* covering ports 112. The restricted thickness of mounting portion 120*b* does not affect the pressure rating of the sub during stimulations in other sections of the well because it is pressure balanced except at the moment when the shifting tool 200 is set proximate to sleeve 120 and prior to sleeve 120 opening.

The thicker portion of exposed portion 120*a* should have an axial length at least as long as the axial length of ports 112. The sleeve may include a shoulder 120*c* where the thickness of the sleeve transitions from thicker to thinner. Shoulder 120*c* may act as a stop for sleeve with respect to end 160*a*, wherein during shifting of the sleeve, shoulder 120*c* cannot pass end 160*a* and therefore shoulder 120*c* stops movement of sleeve 120 deeper into annulus 118.

Figure 5:
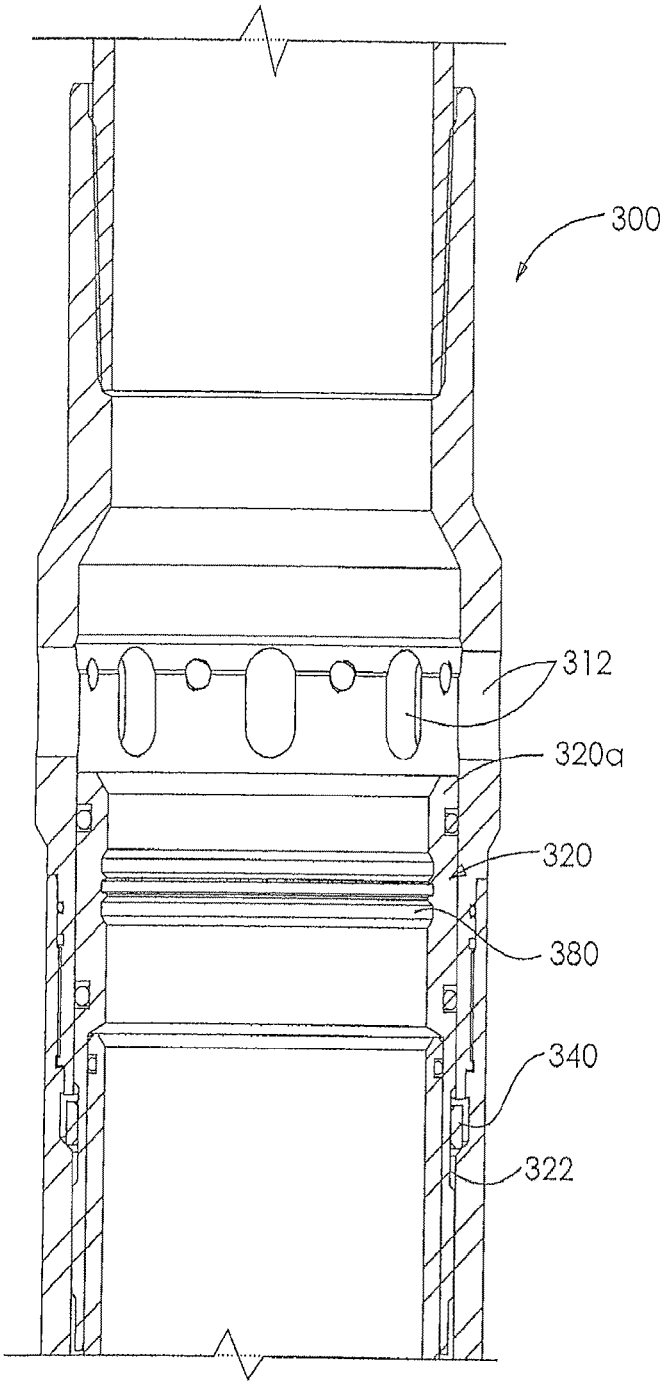
FIG. 5 is a section view of a second embodiment of a tool assembly, wherein the shifting position contains a profile for selective engagement so it may be subsequently closed if desired.

As the sleeve moves between the closed position and the open position, mounting portion 120*b* of the sleeve slides axially in annulus 118. The sleeve 120 may include a locking profile 122 that is configured to engage a locking component 140 (shown in isolation in FIG. 1*c*) on the tubular wall 110. Profile 122 and component 140 are formed to selectively retain the sleeve 120 in its open position. In this illustrated embodiment, profile 122 includes a tooth form that is engaged by teeth 142 on the component. Component 140 may be formed, as shown, as a ring including split 141 that permits some spring properties. In such an embodiment, component 140 can bias into engagement with profile 122. Some locking arrangements provide a permanent locking action and others can be unlocked. Another locking arrangement is shown in FIG. 5, which includes a snap ring 340 and groove 322, which holds sleeve 320 in an open position but can be overcome to move the sleeve back to a closed position, if desired.

Sleeve 120 may be secured in an original, closed position by shear pins 180. Pins 180 may be installed in tubular body 110 and engage indents 121 on the sleeve. One or more shear pins 180 can be used to hold the sleeve 120 in the closed position during installation and to reduce the likelihood of sleeve 120 opening prematurely. If the holding force of shear pins 180 is overcome, the sleeve may be moved. FIG. 1*a* shows a sectional view (though B-B of FIG. 1) through ports 112 with the sleeve 120 in a closed position.

A vent passageway 161 extends through inner wall 160 to place inner diameter ID in fluid communication with the annulus 118. Vent passageway 161 can be a hole, a slot, etc.

The sleeve 120 effectively seals fluid communication to the annulus 118 except through vent passageway 161. Sealing element 133 may be employed to seal off a possible leak path between sleeve 120 and the tubular wall to prevent fluid access to the annulus 118 except through vent passageway 161. While sleeve 120 can move axially within annulus 118, it remains with mounting portion 120*b* in annulus at all times. Thus, a pressure differential can be established between exposed portion 120*a* and mounting portion 120*b* by applying pressure, by way of pumping fluid down or alongside the work string 90, to the upper end of sleeve 120 while the pressure in annulus 118 remains unchanged. The pressure differential may be used to move the sleeve 120 between its closed and open positions. Shear pins 180 may be adapted to shear and release the sleeve 120 upon the application of a predetermined pressure differential, as would be appreciated by one of ordinary skill in the art.

Figures 2, 2A:
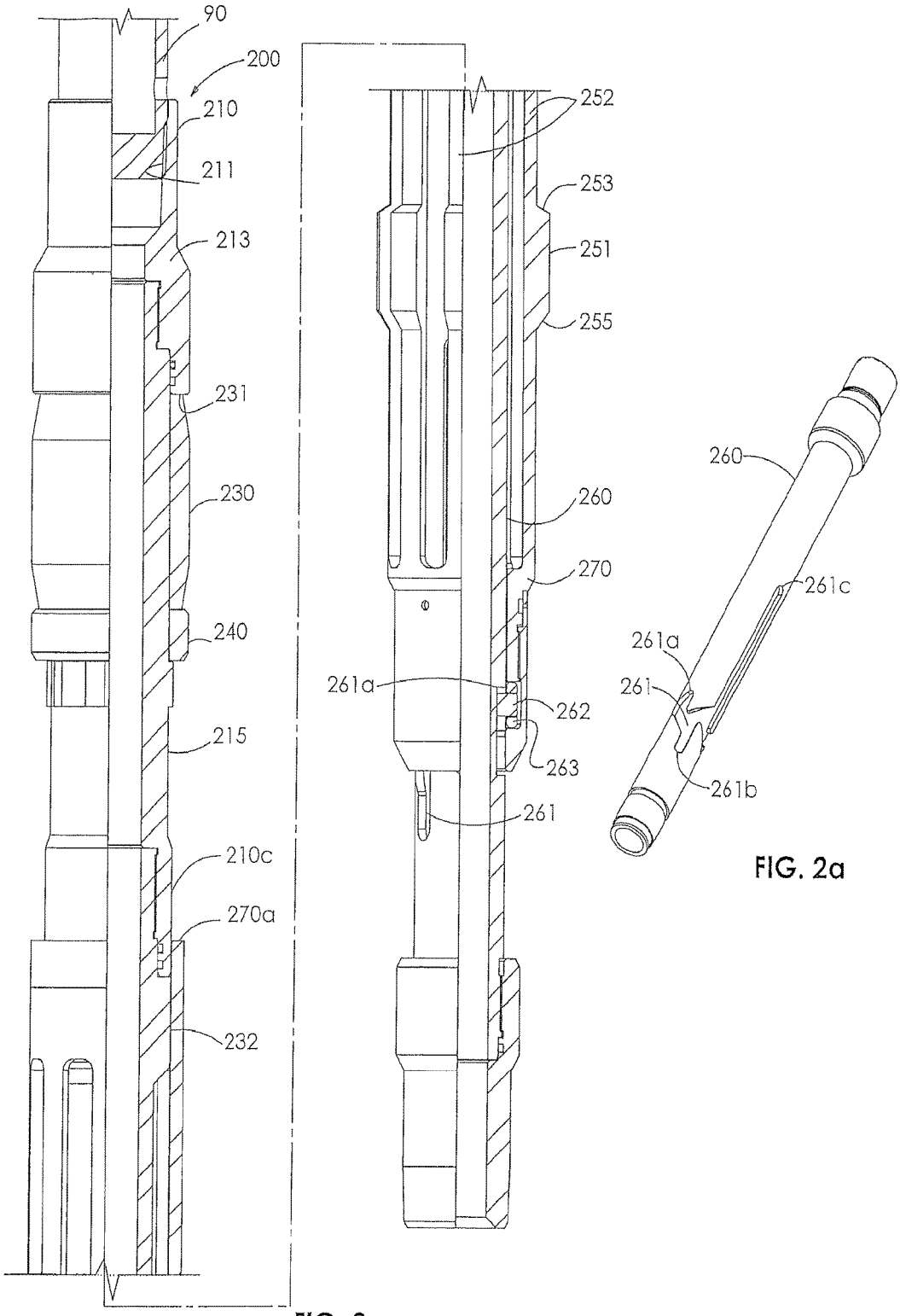
FIG. 2 is a quarter-sectioned view of one embodiment of an associated shifting tool which may be used in conjunction with movement of the shifting piston to open frac ports in the tool assembly.
FIG. 2*a* is a perspective view of the lower tubular wall, specifically the orientation slot, of the associated shifting tool to provide clarity on the functionality of the shifting tool.

As noted above, a shifting tool is used to open the ported sub. One possible shifting tool 200 is illustrated in FIGS. 2 and 2*a* and a method for opening the ported sub is shown in sequence in FIGS. 3 and 4.

The shifting tool 200 is deployed inside the tubing by attachment to the end of a work string 90 (e.g. coiled tubing or jointed pipe).

The shifting piston, herein sleeve 120, can be opened only when the associated shifting tool 200 is placed within the sub and a seal, herein annular packing element 230, is set between the portions 120*a*, 120*b* of the sleeve to permit the generation of a pressure differential above and below the packing element 230 and thereby across the sleeve 120.

Figure 3:
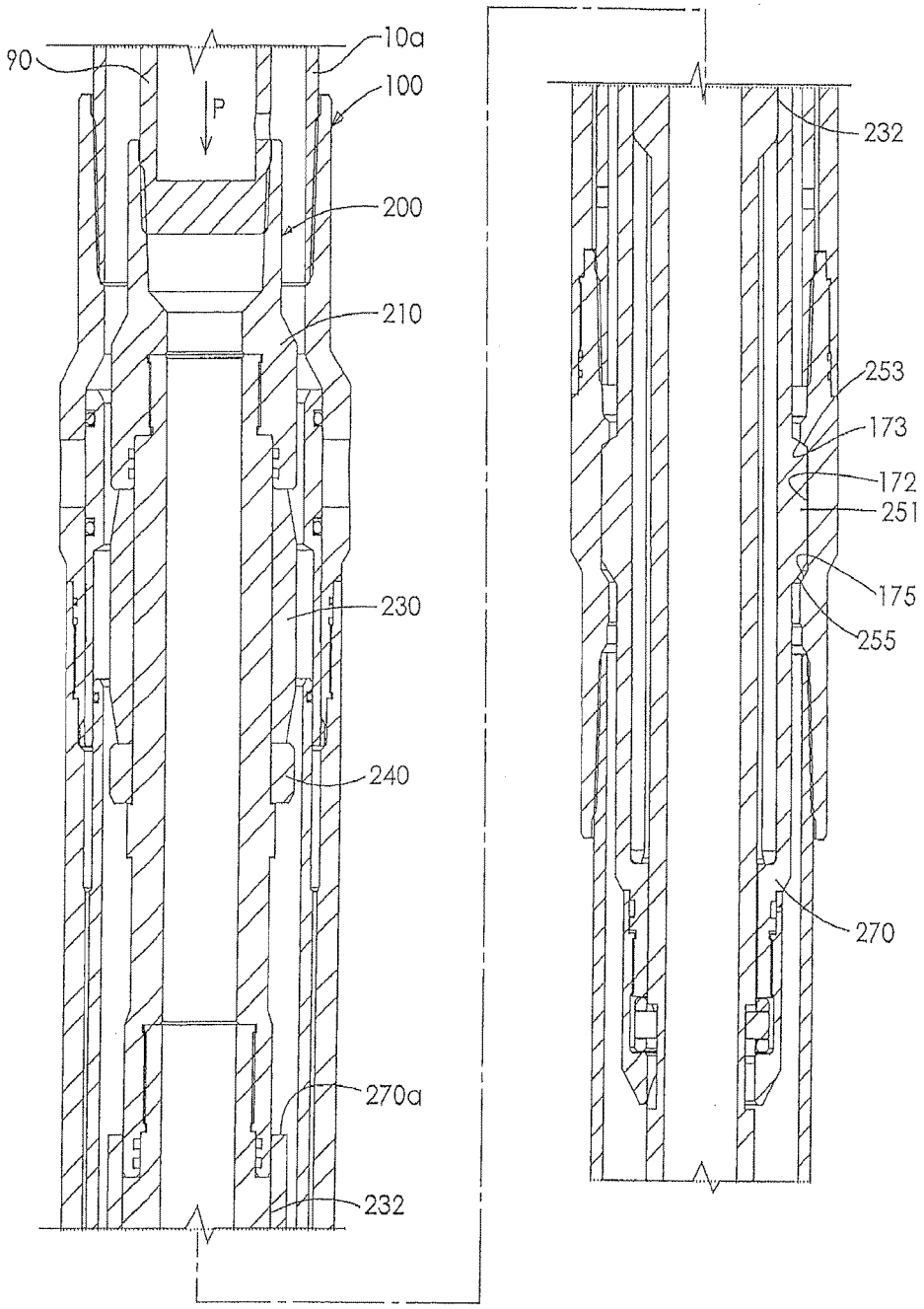
FIG. 3 is a section view of the tool assembly in the run-in, or pressure containing, position with the associated shifting tool shown positioned in the locating, or upwardly stroked, position.

As shown in FIGS. 3 and 4, a packing element 230 can be positioned in the tubing string between the free end 160*a* and the vent passageway 161. When the packing element 230 is energized, it seals on the inner diameter of the sub 100 to prevent or reduce fluid flow further down the tubing. Thus, when fluid flows downhole from surface in an annulus between a well tubing string in which the sub is connected and a shifting tool 200, a pressure differential is formed across packing element 230 and, thereby, between the exposed portion 120*a* of the sleeve and mounting portion 120*b* of the sleeve through vent passageway 161. The pressure differential can be used to move the sleeve 120 to open ports 112.

Little or no pressure differential is likely to be realized between the exposed portion of the sleeve and the vent passageway 161, and therefore annulus 118, of sub 100 until the inner diameter of the sub is sealed off between the exposed portion 120*a* and the vent passageway 161. This means that in multi-zone wells having multiple subs according to this disclosure, the operator can control which fracture port is opened by positioning the shifting tool 200 with its packing element 230 in a desired location without fear that other fracture ports at other locations in the well will inadvertently be opened.

Any suitable technique can be employed to position the packing element 230 at the desired position in the sub 100. Tubular wall 110 is configured to provide a predetermined distance between the sleeve's exposed portion 120*a*, which is that portion protruding from annulus 118 beyond free end 160*a*, and the vent passageway(s) 161. This distance between the free end 160*a* and the vent passageway 161 offers a seal setting surface and the distance may be varied to accommodate the length or configuration of any particular or various packing elements to permit the generation of a pressure differential across from end 120*a* to end 120*b* of sleeve 120. This distance between the free end 160*a* and the vent passageway 161 may be minimized where an assembly including the illustrated shifting tool 200 and ported sub 100 is employed, since the assembly provides for more accurate positioning of the packing element within the sub.

In particular, ported sub 100, or a sub adjacent thereto, may include a locating profile 172 in the inner wall surface of tubular wall 110. Shifting device 200 may include a corresponding locating protrusion 251 sized to fit into locating profile 172 such that a positive location of the shifting tool relative to the ported sub can be ascertained. Locating protrusion 251 may be sized such that it fails to catch on other wellbore structures, such as the gaps at tubular connections. In such an embodiment, the axial length between upper shoulder 173 and lower shoulder 175 of profile 172 may be longer than the gap at a tubular connection and the length of protrusion 251, between its shoulders 253, 255, is sized to be just shorter than the axial length of the profile 172.

During installation, the well operator can install the shifting tool 200 by lowering the protrusion past the profile 172 and then raising the shifting tool 200 up until the protrusion 251 locates into the profile 172. An extra resistance in pulling protrusion 251 out of the profile 172 will be detectable at the surface and can allow the well operator to determine when the shifting tool 200 is correctly positioned in the tubing string. This allows the well operator to locate the packing element 230 relative to the sub 100.

During the running in process, the lower shoulder 255 of protrusion 251 may be profiled such that it doesn't completely engage and/or easily slide past the profiles 172. For example, the profile 172 and protrusion 251 can be configured with shallow angles on their downhole shoulders 175, 255 to allow the protrusion to more easily slide past a profile with a small axial force when running into the well. However, to ensure that the recognizable force is generated that can be sensed for locating the shifting tool, upper shoulder 173 of the profile may have an abrupt angle so that protrusion 251 cannot readily be pulled through.

After the packing element 230 is positioned in the desired location, the packing element 230 can then be activated to seal off the tubing at the shifting tool 200 and the desired sub 100 between exposed portion 120*a* of the sleeve and the vent passageway 161.

The completion assemblies described herein are for annular fracturing techniques where the fracturing fluid is pumped down a well bore annulus between a well tubing string inner wall and shifting tool 200 (and the workstring on which it is carried). However, the sub of the present disclosure can also be employed in other types of fracturing techniques, such as where fluid is conveyed to the sub through the shifting workstring and/or by use of a straddle packer.

After the ports 112 are opened, fluids can be pumped through the ports 112 to the well formation. The stimulation process can be initiated and fracturing fluids can be pumped down the workstring and through the sub to fracture the formation.

In multi-zone wells, the above fracturing process can be repeated for each zone of the well. Thus, the shifting tool 200 can be moved and set in a next sub, the packer can be energized, the fracturing port 112 opened by establishing a pressure differential across the sleeve and the fracturing process carried out. The process can be repeated for each zone of interest from the bottom of the wellbore up.

With the illustrated tool, the fracturing process may be carried out starting at the lowest sub 100 of interest and working up from there.

In an alternative multi-zone embodiment, the fracturing can potentially occur from the top down, or in any order. For example, a shifting tool in the form of a straddle tool can be used to isolate the zones above and below in the well. One of the packing elements of the straddle packer, likely the lower one, may be positioned between the exposed end of the sleeve and the vent passageway. The fracture ports 112 can then be opened by creating a pressure differential across the sleeve, as by pressuring up through the string on which the straddle packer is carried. Fracturing can then occur for the first zone, also in a similar fashion as described above. The straddle tool can then be moved to the second zone of interest uphole or downhole from the first and the process repeated. Because the straddle tool can isolate a sub from the subs above and below, the straddle tool permits the fracture of any zone along the wellbore and eliminates the requirement to begin fracturing at the lower most zone and working up the tubing string.

In some embodiments, the ports of sub 100 can be closed after they have been opened. This may be beneficial in cases were certain zones in a multi-zone well begin producing water, sand or other unwanted media. If the zones that produce the water can be located, the sub or subs associated with that zone can be closed to prevent the undesired fluid flow from the zone. This can be accomplished in various ways. For example, if there was no lock 140, the sleeve 120 could be shifted to close ports 112 by isolating the vent passageway 161 and then pressuring up to force the sleeve 120 out of annulus 118, and thereby closed. For example, a straddle tool can be employed wherein one of the packing elements is positioned between exposed portion 120*a* and the vent passageway 161 and the other packing element can be positioned on the far side (opposite from end 160*a*) of the vent passageway 161. When the zone between the packers is pressurized, it creates a high pressure at the vent passageway 161 and in annulus 118 that forces the sleeve 120 closed.

Sleeve 120 can also be shifted closed by engaging the sleeve at exposed portion 120*a* and moving it over the ports. For example, in one embodiment illustrated in FIG. 5, a sub 300 may include a sleeve 320 with a shifting profile 380 on its exposed end 320*a*. A shifting tool (not shown) may be employed to engage in shifting profile 380 and move sleeve 320 into a position overlying ports 312.

While sub may be employed with various shifting tools, the shifting tool 200 of FIGS. 2 and 2*a* and its operation will be described in greater detail.

Shifting tool 200 includes a tubular mandrel 210 including an upper end 213, a lower end 260 and an outer surface 210*c* extending therebetween. As noted above, as is common in wellbore operations, the tool can include subcomponents that are connected to form the base parts. For example, as illustrated here, the tubular mandrel may include an intermediate body 215 connected between ends 213 and 260.

The shifting tool can be carried on a string by connection of workstring 90 directly, or via workstring components, at end 213. The upper end may therefore be formed for connection into a string in various ways. For example, it can be threaded, as shown at 211. Alternately, the ends may have other forms or structures to permit alternate forms of string connection.

The shifting tool further includes a locating assembly 270 and a packer assembly, including packing element 230. Each of locating assembly 270 and the packer assembly have a tubular form and each have an inner facing surface defining an inner bore therethrough. Each of locating assembly 270 and the packer assembly are mounted over tubular mandrel 210 with the mandrel passing through their inner bores. Each of locating assembly 270 and the packer assembly are axially moveable along at least a portion of the length of the tubular mandrel and are configurable between a packing element unset position (FIGS. 2 and 3) and a packing element set position (FIG. 4).

The packer assembly includes packing element 230, which is annularly formed and encircles mandrel 210. The packer assembly further includes element compression collar 240, which is annularly formed to encircle mandrel 210. Packing element 230 is positioned between compression collar 240 and a shoulder 231, which here is a portion of mandrel 210 but may be a separate part if desired.

Packing element 230 becomes set to create a seal in the wellbore by compression. For example, in the packing element unset position the packer assembly is in a neutral, uncompressed position with packing element 230 in a neutral position with an outer diameter less than the inner diameter ID of the bore in which it is intended to be set, shown here as constraining inner wall 110, in which packing element is be set. However, when in the packing element set position, packer element 230 is in a compressed condition, extruded radially outwardly. For example, when in use and in a set position, element 230 has an outer diameter pressed against the constraining wall and therefore equal to the inner diameter of any bore in which the tool is positioned. Alternatively, packing element 230 may be configured such that it is always in contact with the tubing inside diameter, such as a swab cup type element. Shifting tool 200 may be returned to the packing element unset position by releasing the compressive force on the packing assembly, after which the packing element will return to a retracted position.

Packing element 230 is formed of deformable, resilient, elastomeric material such as rubber or other polymers and upon application of compressive forces against the sides thereof, it can be squeezed radially out.

Compression collar 240 and shoulder 231 of mandrel are formed of rigid materials such as steel and transfer compressive forces to the packing element.

Compression of element 230 may be as a result of reducing the distance between collar 240 and the shoulder 231. This means moving collar 240 toward the shoulder 231, which is fixed and remains stationary on mandrel 210. However, collar 240 may be moved by pushing thereon or by holding it stationary while the mandrel is moved to move shoulder 231 toward the collar 240. For downhole use, routinely force is applied from surface by manipulation of the workstring onto which the shifting tool is connected, while a part of the tool is held steady or moved in an opposite direction. For example, if shifting tool 200 is installed with end 213 connected to a workstring 90 with the workstring extending uphole to surface, force can be applied by lowering or lifting the workstring, which in turn moves mandrel 210. In this embodiment, as shown, the packing elements of the shifting tool can be compressed by moving the tubing string attached at end 213 down, while collar 240 is held stationary or moved up. This shifting tool, then may be deployed using workstring 90 such as of coiled tubing or jointed tubing. The packer may be set and released using tubing reciprocation: put weight on (lower) the string to set the packer and pick up on the string (pull up) to release the packer.

Locating assembly 270 acts as an anchor for permitting relative movement between shoulder 231 and collar 240 and therefore compression of the packing element. Locating assembly 270 is employed to create a fixed stop against which the packing element housing can be compressed. Locating assembly 270 works with mandrel 210 to effect compression.

As noted above, locating assembly 270 has a tubular form and is sleeved over and axially moveable along mandrel 210. Locating assembly 270 includes a locking mechanism for locking its position relative to sub 100 in which shifting tool 200 is employed. For example, locating assembly 270 may include an annular body and protrusions 251 carried by the annular body. Protrusions 251 are formed to contact the inner wall surface of sub 100. Protrusions 251 have an effective diameter D thereacross that is larger than inner diameter ID of the sub and protrusions 251 are compressible to fit within the ID but are biased radially outwardly from the tool to bear against the inner wall surface and expand into profile 172 when they are aligned over it.

In this embodiment, the annular body of locating assembly 270 is formed as a collet with protrusions 251 formed on collet fingers 252. Collet fingers 252 can flex inwardly by application of force but are biased out. Thus the collet fingers bias the protrusions radially out away from mandrel 210.

The tool may include a support to lock the collet fingers against flexing. For example, in the illustrated embodiment, mandrel 210 includes an enlarged area 232 that can be positioned behind collet fingers 252 to stop them from flexing inwardly.

When the tool is positioned in an inner bore such as in tubing string 8 and sub 100, protrusions 251 frictionally engage, and provide resistance to movement of the annular housing along the inner wall surface. While protrusions 251 can be forced to move across the wall surface, they frictionally engage against the wall such that a resistance force is generated by movement of blocks across the surface. This resistance is transferred to assembly 270 such that its movement relative to the inner wall is also resisted and the locating assembly 270 can only be moved along by applying a force to it, for example by pushing or pulling the mandrel 210 against the locating assembly 270. When in a bore, for example, where the protrusions engage against a constraining wall of the bore, the mandrel can be moved through locating assembly 270, while the locating assembly 270 remains stationary, until the mandrel butts against the locating assembly. Thereafter, the locating assembly 270 can be moved along with the mandrel 210. If the mandrel is stopped and moved in an opposite direction, mandrel 210 moves through locating assembly 270, with the locating assembly 270 remaining stationary, until the mandrel 210 applies a force against the locating assembly 270 to move it in that opposite direction. Mandrel 210 therefore may include a shoulder or other engagement mechanism to apply force to the locating assembly 270 to effect movement of locating assembly 270. In the illustrated embodiment, the engagement mechanism includes a key 262 that rides in a slot 261, as will be described hereinafter.

The above-noted use of mandrel 210 to move locating assembly 270 can occur only when locating assembly can be moved. However, the locating assembly 270 can be locked into a position such that mandrel cannot move it when protrusions 251 are located in profile 172. When this occurs, movement of workstring 90 moves mandrel 210 through locating assembly 270 and can cause compression of packing element 230 by bearing and compression collar 240 against upper end 270*a* of the locating assembly 270 while shoulder 231 moves with the mandrel 210 against element 230 and element is compressed between shoulder 231 and compression collar 240. In this position, the mandrel 210 is also moved to position enlarged area 232 behind protrusions 251 so that they cannot move out of engagement with profile 172.

Locating assembly 270 and the packer assembly are sleeved over and axially movable along tubular mandrel 210 and the parts are intended to remain as such during operation such that they cannot fully separate from each other. However, as noted, the locating assembly 270 and the packer assembly are axially moveable relative to the mandrel between the packing element unset position, wherein the parts are neutral and uncompressed and the packing element set position, wherein the parts are compressed causing the packing element to be driven outwardly into contact with the constraining wall.

The shifting tool may be reciprocated between the unset and the set positions by axial movement of the mandrel 210 relative to the locating assembly 270. For example, movement of the mandrel 210 to move shoulder 231 away from locating assembly 270 causes the packing element 230 to become unset, while movement of the mandrel 210 to move shoulder 231 toward locating assembly 270, when it is locked in place with protrusions 251 in profile 172, causes the mandrel to be pushed through locating assembly 270 and element 230 to become squeezed between shoulder 231 and collar 240, which becomes stopped against upper end 270*a* (of locating assembly 270), and a compressive force is applied to the packing element 230 causing it to set.

The shifting tool 200 further includes an indexing mechanism to control when movement of the mandrel is capable of setting the packing element 230. In particular, it will be appreciated that since downward movement of the mandrel 210 through the locating assembly 270, it is possible that normal downward movement to position the shifting tool 210 could in fact be resisted by action of protrusions 251 bearing against the normal inner diameter and may accidentally cause the packing element 230 to set. For example, whenever the packer assembly is moved down through a wellbore, the packing element 230 could set.

Thus, in one embodiment, shifting tool 200 includes a position indexing mechanism employed to direct the movement of the locating assembly 270 relative to the tubular mandrel 210, between a position where it will operate to drive the packing elements 230 to set and a position in which locating assembly 270 is inactive (where protrusions 251 are not supported by enlarged area 232) and inoperative to drive the packing elements to set. The position indexing mechanism may, for example, include J-slot indexing mechanism including a slot 261 and a key 262. The slot and the key may be positioned between the locating assembly 270 and the mandrel 210, for example in the gap between outer facing surface 210*c* and the inner facing surface of the locating assembly 270. In this embodiment, slot 261 is formed on the mandrel and key 262 is carried on the locating assembly, but this orientation can be reversed if desired. The key is sometimes termed a guide pin or J-pin since it rides along within the J-slot.

The key 262 may be on a sleeve 263 that is axially fixed on the locating assembly but about which the locating assembly can rotate. Thus, the key and the slot force the locating assembly to move axially but may not also cause rotation thereof.

The position indexing mechanism guides the axial movement between the locating assembly 270 and the mandrel 210. For example, the axial length of slot 261 between its ends and the relative position of the key may be selected to allow sufficient axial movement of the sleeve 263 and the mandrel to allow the packing element 230 to be set and unset and slot 260 can further be configured to permit axial movement of the mandrel and the locating assembly to be positively stopped in an intermediate inactive, unsettable position, wherein setting of the packing element 230 is prevented in spite of movement of the mandrel 210 which would otherwise cause the packing element 230 to set. This can be achieved, for example, by forming the slot as a J-type slot.

In one embodiment a continuous J-type slot 260 may be provided about the circumference of mandrel 210 so that the mandrel can be continuously cycled between active positions and inactive positions relative to the locating assembly 270. One possible layout for a J-type slot 261 is shown in FIG. 2*a*.

The key reacts with the side and end walls of J-slot 261 to provide a guiding function to move locating assembly 270 axially relative to mandrel 210 and permits the locating assembly 270 and the mandrel 210 to be indexed between the unset, uncompressed position and the set, compressed position and also positively into at least one intermediate unset position. While the slot geometry can vary, in this illustrated embodiment, the J-slot includes a number of stop areas and adjoining angled slot sections therebetween. The stop areas include: unset stop area 261*a*, unset stop area 261*b* and set stop area 261*c*. Each stop area has an angled slot section extending away toward the next stop area. The slot geometry allows the mandrel to be moved axially within the locating assembly according to the axial spacing between the various end walls. Bearing in mind that the locating assembly 270 is selected to resist movement during use, the angled slot sections cause axial movement of the mandrel 210 within the locating assembly 270 to move the mandrel from stop area to stop area along the slot, as the tool is reciprocated. In particular, any pushing or pulling movement of the shifting tool acting axially through end 213 will cause key 262 to ride through the slot and eventually land against an end wall in a stop area. Thereafter, any pushing or pulling movement in an opposite direction causes key to move axially away from the previous end wall and engage an axially aligned angled slot section. As the angled slot section is contacted by key 262, an indexing rotation will be applied to the tubular mandrel and the key will move until stopped against the next end wall in the slot. The key can only advance to the next position, if the pushing or pulling movement is again reversed. The angled sections are formed such that the key is always forced to move in a predefined path, and reverse movement cannot be readily achieved.

The movement of key 262 through slot 261 can be further understood by reference to FIGS. 3 and 4, which show the packer in use in a wellbore. FIG. 3 shows the shifting tool just after protrusions 251 have been pushed down into profile 172. In this condition, workstring 90 is applying a push force, arrow P, to mandrel 210 and the mandrel is pushed down with key 262 in unset stop area 261*a*. In this orientation, the locating assembly and packer assembly are both neutral. Protrusions 251 can push out of profile 172 if sufficient force is applied and packing element 230 remains relaxed or retracted. Locating assembly 270 is moved along with the mandrel 210 but rides along spaced away from collar 240 and closer to the lower end than the upper end, in a position established by J-slot 261. Packing element 230 may be selected to have a neutral outer diameter in the relaxed state that is less than the inner diameter ID of tubing string 10 and sub 100 such that the packing element 230 does not contact the wall as the shifting tool 200 is moved along. This mitigates stuck conditions and avoids problematic wear to the packing element.

After the shifting tool locates profile 172, the location of the shifting tool can be confirmed by pulling up on workstring 90. This pulls mandrel 210 up to unset stop area 261*b* and eventually moves protrusions 251 up until a greater pull force is sensed, wherein the protrusions are trying to pull out of the profile. This confirms the location of the shifting tool.

When the shifting tool is appropriately positioned the packing element 230 can be set. As shown in FIG. 4, mandrel 210 is then pushed down through locating assembly 270 as it remains in place due to the engagement of protrusions 251 in profile 172. This movement therefore moves mandrel 210 down through the locating assembly 270 and key 262 rides along slot 261 toward stop area 261*c*. Also, enlarged area 232 moves behind protrusions 251 so that they cannot collapse out of profile 172 and any downward movement of locating assembly 270 is stopped when lower shoulder 255 hits shoulder 175.

Mandrel 210 thus moves into a position with the packer assembly, and in particular collar 240, bearing against end 270*a* of the locating assembly and continued movement, away from surface, of mandrel 210 drives shoulder 231 against packing element 230. Since collar 240 stops axial movement of packing element 230, it is extruded outwardly to seal against the inner wall 160.

During this movement of mandrel 210 through the locating assembly 270, key 262 continues along slot 261 until it reaches a position near stop area 261*c*. Stop area 261*c* may, in fact, be formed with sufficient space such that key 262 never stops against a wall during normal use such that the compressive load applied into element 230 is not limited by any interaction of key and slot.

In this position, the space between element 230 creates a seal between upper end 160*a* of inner wall and vent passageway 161 and fluid can be injected into the annular space between end 113 and exposed portion 120*a* of the sleeve 120 to establish a pressure differential to which creates a breaking force against shear pins 180. Once the shear pins 180 break then the pressure differential causes sleeve 120 to move and configure ports 112 in the open condition. Ports 112 being open, fluid can be injected, arrows F, through the tubing string 10 and out through the ports 112 into contact with the formation, if desired. Because of the seal provided by element 230 considerable pressures can be achieved above the element and such fluid is diverted out to treat the formation.

When it is desired to unset the packer, workstring 90 can be pulled up such that mandrel 210 is pulled up through the locating assembly 270. Initially, the mandrel's movement will remove shoulder 231 from its compressing position against element 230, which allows that packing element to relax and retract from a sealing position. Thereafter, as the mandrel 210 is further pulled up, the enlarged area 232 will be pulled from behind protrusions 251 and allowing collet fingers 252 to flex such that protrusions 251 can be pulled from profile 172. During this movement, key 262 rides along the slot into one of the unset stop areas, likely one similar to 261 b, but out of view in FIG. 2*a*.

At this point, work at this area of the well is done and the shifting tool 200 can be moved up or down through the wellbore. Generally, the shifting tool will be moved uphole to a next sub 100 of interest and the operations will be repeated. Because element 230, when set, creates a seal against fluids moving therepast, the ports of sub 100 can remain open.

The sleeve 120 can be closed thereafter if desired by one of the processes described above.

The previous description of the disclosed embodiments is provided to enable any person skilled in the art to make or use the present invention. Various modifications to those embodiments will be readily apparent to those skilled in the art, and the generic principles defined herein may be applied to other embodiments. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A tubing string sub comprising:

a tubular wall defining an inner bore;

at least one port through the wall to provide fluid communication between an outer surface of the tubular wall and the inner bore;

a valve chamber within the tubular wall adjacent to the port, the valve chamber having an open end, and a closed end having a vent passageway to fluidly couple the inner bore and the valve chamber; and a valve having a first portion mounted in the valve chamber, and a second portion protruding from the open end of the valve chamber and covering the port, the valve being configured to axially shift more deeply into the valve chamber to open the port when a pressure differential is created between the second portion protruding from the open end, and the first portion mounted in the valve chamber having the vent passageway, wherein the second portion has a radial thickness greater than a radial thickness of the first portion and the second portion is mechanically engageable by a shifting tool located in the inner bore.

2. The tubing string sub of claim 1 wherein the valve chamber is an annulus.

3. The tubing string sub of claim 2 wherein the valve is a sleeve with the first portion movable within the annulus.

4. The tubing string sub of claim 3 further comprising a shoulder on the sleeve between the second portion and the first portion where the thickness transitions to the radial thickness.

5. The tubing string sub of claim 1 wherein a full circumference of the second portion protruding from the open end is exposed in the inner bore.

6. The tubing string sub of claim 1 further comprising a locating profile in the wall.

7. The tubing string sub of claim 1 wherein the vent passageway is a hole.

8. The tubing string sub of claim 1, wherein the second portion has an exposed annular recess for engagement by a port closing tool.

9. The tubing string sub of claim 1 wherein the valve further comprises a locking profile on the second portion of the valve, the locking profile adapted to secure the valve in a port covered condition during installation, and to be engageable with a mating profile of a tool provided in the tubing string.

10. The tubing string sub of claim 1 further comprising a plurality of protrusions on the tubular wall for engagement with a locating assembly on a shifting tool.

11. A method for stimulating a wellbore, the method comprising:

moving a shifting tool comprising a seal within a tubing string in the wellbore to a position adjacent a tubing string sub, the sub including: a tubular wall defining an inner bore; at least one port through the wall to provide fluid communication between an outer surface of the tubular wall and the inner bore; a valve chamber within the tubular wall adjacent to the port, the valve chamber having an open end and a closed end with a vent passageway to fluidly couple the inner bore and the valve chamber; and a valve having a mounting portion mounted in the valve chamber and a second portion protruding from the open end of the valve chamber and covering the port, the second portion having a radial thickness greater than a radial thickness of the mounting portion, and the valve being configured to axially shift more deeply into the valve chamber for uncovering the port when a pressure differential is created between the second portion protruding from the open end and the mounting portion mounted in the valve chamber having the vent passageway; and, setting the seal so as to permit the creation of the pressure differential between the second portion protruding from the open end and the mounting portion mounted in the valve chamber having the vent passageway;

applying increased pressure to the second portion protruding from the open end, to shift the valve deeper into the valve chamber to uncover the port, using the shifting tool, to mechanically engage the second portion of the valve protruding from the open end and to partially withdraw the valve from the valve chamber to cover the port.

12. The method of claim 11 further comprising creating the pressure differential by pumping fluid through an annular area between a work string for the shifting tool and the tubing string from a position above the shifting tool.

13. The method of claim 11 wherein setting the seal comprises setting a packing element of the shifting tool between the open end and the vent passageway.

14. The method of claim 13 further comprising creating the pressure differential across the packing element.

15. The method of claim 14, wherein the pressure differential is created by applying pressure in the inner bore uphole from the packing element.

16. The method of claim 11, wherein the shifting tool is moved in the inner bore using a work string.

17. The method of claim 11, wherein the step of using the shifting tool to engage the second portion of the valve protruding from the open end, and to partially withdraw the valve from the valve chamber to cover the port, is performed in response to the wellbore producing water.

* * * * *